US006972739B2

(12) United States Patent
Kim

(10) Patent No.: US 6,972,739 B2
(45) Date of Patent: Dec. 6, 2005

(54) DRIVING METHOD OF PLASMA DISPLAY PANEL

(75) Inventor: Joong Kyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 10/216,444

(22) Filed: Aug. 12, 2002

(65) Prior Publication Data

US 2003/0030599 A1 Feb. 13, 2003

(30) Foreign Application Priority Data

Aug. 13, 2001 (KR) ..... 2001-48771

(51) Int. Cl.[7] ..... G09G 3/28

(52) U.S. Cl. ..... 345/60; 345/68

(58) Field of Search ..... 345/60, 67, 68; 315/169.4

(56) References Cited

U.S. PATENT DOCUMENTS

| | | | | |
|---|---|---|---|---|
| 5,155,414 | A * | 10/1992 | Sano | 315/169.4 |
| 5,790,087 | A * | 8/1998 | Shigeta et al. | 345/67 |
| 5,877,734 | A * | 3/1999 | Amemiya | 345/60 |
| 6,414,653 | B1 * | 7/2002 | Kobayashi | 345/60 |
| 6,597,334 | B1 * | 7/2003 | Nakamura | 345/68 |
| 6,707,436 | B2 * | 3/2004 | Setoguchi et al. | 345/60 |

* cited by examiner

*Primary Examiner*—Guy Lamarre
*Assistant Examiner*—Fritz Alphonse
(74) *Attorney, Agent, or Firm*—Fleshner & Kim, LLP

(57) ABSTRACT

A method of driving a plasma display panel that is adaptive for improving a picture quality. In the method, a scanning pulse is applied to first electrodes so as to select a discharge cell in an address period. A data pulse synchronized with the scanning pulse is applied to address electrodes arranged to cross the first electrodes. A reset pulse is applied to the first electrodes in the reset period, and a pulse width of the reset pulse is set differently depending upon an application sequence of the scanning pulse.

31 Claims, 12 Drawing Sheets

DRIVING METHOD OF PLASMA DISPLAY PANEL

BACKGROUND OF THE INVENTION

1. Field of the Invention

This invention relates to a plasma display panel, and more particularly to a method of driving a plasma display panel that is adaptive for improving a picture quality.

2. Description of the Related Art

Recently, a plasma display panel (PDP) feasible to a manufacturing of a large-dimension panel has been highlighted as a flat panel display device. The PDP typically includes a three-electrode, alternating current (AC) surface discharge PDP that has three electrodes and is driven with an AC voltage as shown in FIG. 1.

Referring to FIG. 1, a discharge cell of the conventional three-electrode, AC surface-discharge PDP includes a first electrode 12Y and a second electrode 12Z provided on an upper substrate 10, and an address electrode 20X provided on a lower substrate 18.

On the upper substrate 10 provided with the first electrode 12Y and the second electrode 12Z in parallel, an upper dielectric layer 14 and a protective film 16 are disposed. Wall charges generated upon plasma discharge are accumulated into the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO).

A lower dielectric layer 22 and barrier ribs 24 are formed on the lower substrate 18 provided with the address electrode 20X. The surfaces of the lower dielectric layer 22 and the barrier ribs 24 are coated with a fluorescent material 26. The address electrode 20X is formed in a direction crossing the first electrode 12Y and the second electrode 12Z. The barrier rib 24 is formed in parallel to the address electrode 20X to prevent an ultraviolet ray and a visible light generated by a discharge from being leaked to the adjacent discharge cells. The fluorescent material 26 is excited ,by an ultraviolet ray generated during the plasma discharge to generate any one of red, green and blue visible light rays. An inactive gas for a gas discharge is injected into a discharge space defined between the upper and lower substrate 10 and 18 and the barrier rib 24.

Such discharge cells are arranged in a matrix type as shown in FIG. 2. In FIG. 2, the discharge cell 1 are provided at each intersection among first electrode lines Y1 to Ym, second electrode lines Z1 to Zm and address electrode lines X1 to Xn. The first electrode lines Y1 to Ym are driven sequentially while the second electrode lines Z1 to Zm are driven commonly. The address electrode lines X1 to Xn are divided into odd-numbered lines and even-numbered lines for their driving.

Such a three-electrode AC surface-discharge PDP is divided into a plurality of sub-fields for its driving. In each sub-field period, a light-emission having a frequency proportional to a weighting value of a video data is conducted to provide a gray scale display.

For instance, when a picture of 256 gray levels is displayed using a 8-bit video data, 1 frame display interval at each discharge cell 1, which is equal to 1/60 second (i.e. 16.67 msec), is divided into 8 sub-fields SF1 to SF8 as shown in FIG. 3. Each of the 8 sub-fields SF1 to SF8 is again divided into a reset period, an address period and a sustain period. In the sustain period, weighting values are given at a ratio of 1:2:4:8 . . . :128. Herein, the reset period is an interval for initializing a discharge cell, and the address period is an interval for generating a selective address discharge in accordance with a logical value of a video data. The sustain period is an interval for causing a discharge cell at which an address discharge has been generated to sustain the discharge. The reset period and the address period are assigned equally with respect to each other in each sub-field period, whereas the sustain period is increased for each sub-field period depending upon a weighting value.

FIG. 4 is a waveform diagram representing a conventional PDP driving method.

Referring to FIG. 4, the conventional PDP is divided into a reset period, an address period and a sustain period for its driving.

In the reset period, a reset pulse RP is commonly applied to the first electrode lines Y1 to Ym to initialize a discharge cell. In the address period, a scanning pulse SP is sequentially applied to the first electrode lines Y1 to Ym while a data pulse DP synchronized with the scanning pulse SP is applied to the address electrode lines X. At this time, an address discharge is generated at the discharge cells to which the scanning pulse SP and the data pulse DP are applied. In the sustain period, sustain pulses SUSPy and SUSPZ are alternately applied to the first electrode lines Y1 to Ym and the second electrode lines Z1 to Zm, to thereby cause a sustain discharge at the discharge cell at which the address discharge has been generated during a desired time.

A reset pulse RP applied in the reset period will be described.

First, a reset discharge is generated at the discharge cells in t1 interval when the reset pulse RP rises at a desired slope. Accordingly, desired wall charges are formed at the discharge cells in the t1 interval. In t2 interval, the wall charges formed at a desired voltage value in the t1 interval are maintained. In t3 interval, the wall charges formed at a lower voltage than that in the t2 interval in the t1 interval are maintained. In t4 interval, the wall charges formed at the discharge cells with a voltage value falling slowly at a desired slope are uniformly distributed. As described above, the wall charges formed in the reset period provides a wall voltage corresponding to an amount of the wall charges with the discharge cells, thereby allowing the discharge cells to generate an address discharge easily.

In the address period following the reset period, a scanning pulse SP is sequentially applied to the first electrode lines Y1 to Ym, and a data pulse DP synchronized with the scanning pulse SP is applied to the address electrode lines X1 to Xn. At this time, a picture displayed on the panel determines whether or not the data pulse DP is applied. An address discharge occurs at the discharge cells supplied with the scanning pulse SP and the data pulse DP. Desired wall charges are formed at the discharge cells at which such an address discharge has been generated by the address discharge.

In the sustain period, sustain pulses SUSPy and SUSPz are alternately applied to the first electrode lines Y1 to Ym and the second electrode lines Z1 to Zm, thereby causing a sustain discharge at the discharge cells at which the address discharge has been generated.

However, in the above-mentioned conventional PDP, an application time difference between the reset pulse RP and the scanning pulse SP are set differently with respect to each other depending upon a position of the first electrode lines Y1 to Ym because the scanning pulse SP is sequentially applied. In other words, as shown in FIG. 5, the scanning pulse SP is applied to the (Y1)th first electrode line Y1 after the lapse of t5 time from an application of the reset pulse RP.

Further, the scanning pulse SP is applied to the (Ym/2)th first electrode line Ym/2 after the lapse of t6 time from an application of the reset pulse RP. The scanning pulse SP is applied to the (Ym)th first electrode line Ym after the lapse of t7 time from an application of the reset pulse RP. Herein, said time is set to have a larger value at a sequence of t7, t6 and t5.

In the mean time, the wall charges produced by the reset discharge expire in accordance with the lapse of time due to their re-binding, etc. Accordingly, even though uniform wall charges are formed at all the discharge cells by the reset discharge, it is impossible to cause a uniform address discharge because an application time of the scanning pulse SP is not equal at all the discharge.

Particularly, if the scanning pulse SP is applied after a desired time from an application of the reset pulse RP like the (Ym)th first electrode line Ym, then a normal address discharge may not be generated due to an expiration of wall charges, that is, a reduction of a wall voltage. Also, the discharge cells supplied with the scanning pulse SP after a desired time from an application of the reset pulse RP generate a weak address discharge due to an expiration of wall charges produced by the reset discharge, and hence fail to generate a desired sustain discharge to cause a deterioration of picture quality.

SUMMARY OF THE INVENTION

Accordingly, it is an object of the present invention to provide a method of driving a plasma display panel that is adaptive for improving a picture quality.

In order to achieve these and other objects of the invention, a method of driving a plasma display panel according to one embodiment of the present invention includes the steps of applying a scanning pulse to first electrodes so as to select a discharge cell in an address period; applying a data pulse synchronized with the scanning pulse to address electrodes arranged to cross the first electrodes; and applying a reset pulse to the first electrodes in a reset period, and setting a pulse width of the reset pulse differently depending upon an application sequence of the scanning pulse.

In the method, said pulse width of the reset pulse is set such that the scanning pulse can be applied to all the first electrodes after the lapse of the same time from an application of the reset pulse.

Said reset pulse includes a rising step rising at a desired slope until a first voltage; a first sustain step for sustaining said first voltage during a desired time; a second sustain step for sustaining a second voltage having a lower voltage value than the first voltage during a certain time; and a falling step falling at a desired slope from the second voltage.

A width of the first sustain step is set such that said scanning pulse can be applied to all the first electrodes after the lapse of the same time from an application of the reset pulse.

Widths of the rising step, the second sustain step and the falling step are set equally at all the reset pulses applied to the first electrodes.

Alternatively, a width of the second sustain step is set such that said scanning pulse can be applied to all the first electrodes after the lapse of the same time from an application of the reset pulse.

Widths of the rising step, the first sustain step and the falling step are set equally at all the reset pulses applied to the first electrodes.

Widths of the first sustain step and the second sustain step are set such that said scanning pulse can be applied to all the first electrodes after the lapse of the same time from an application of the reset pulse.

Widths of the rising step and the falling step are set equally at all the reset pulses applied to the first electrodes.

Said plasma display panel is divided into a plurality of blocks, each of which includes at least two first electrodes, for its driving.

A width of at least one of the first and second sustain steps is set such that said scanning pulse can be applied to the first electrodes after the lapse of the same time after an application of the reset pulse for each block.

Reset pulses with the same width are applied the first electrodes included in the same block.

Said plasma display panel is divided into an upper block and a lower block, which are driven simultaneously.

A method of driving a plasma display panel according to another embodiment of the present invention includes the steps of applying a scanning pulse to first electrodes so as to select a discharge cell in an address period; applying a data pulse synchronized with the scanning pulse to address electrodes arranged to cross the first electrodes; and applying reset pulses having a different application time, depending upon positions of the first electrodes, in a reset period.

In the method, said application time of the reset pulse is set such that the scanning pulse can be applied to the first electrodes after the lapse of the same time.

Said plasma display panel is divided into an upper block and a lower block, which are driven simultaneously.

A method of driving a plasma display panel according to still another embodiment of the present invention includes the steps of applying a reset pulse with a ramp waveform shape to first electrodes in a reset period; applying a scanning pulse to the first electrodes in an address period; applying a data pulse synchronized with the scanning pulse so as to select a discharge cell in said address period; applying a first voltage to second electrodes being adjacent to the first electrodes when said ramp waveform is applied to the first electrodes; and applying a second voltage to the second electrodes before an application of the first scanning pulse to the first electrode after an application of said ramp waveform to the first electrodes.

In the method, said second voltage is set to have a higher voltage level than said first voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
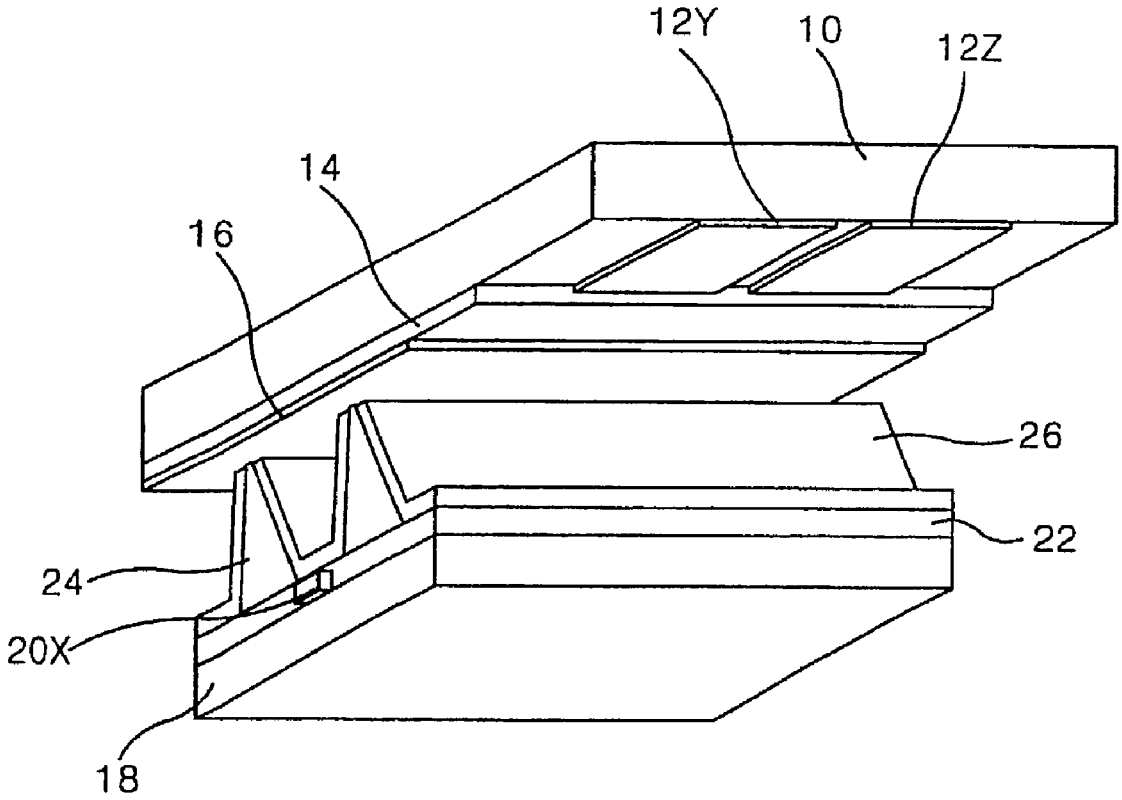
FIG. 1 CONVENTIONAL ART
FIG. 1 is a perspective view showing a discharge cell structure of a conventional three-electrode, AC surface-discharge plasma display panel.
Figure 2:
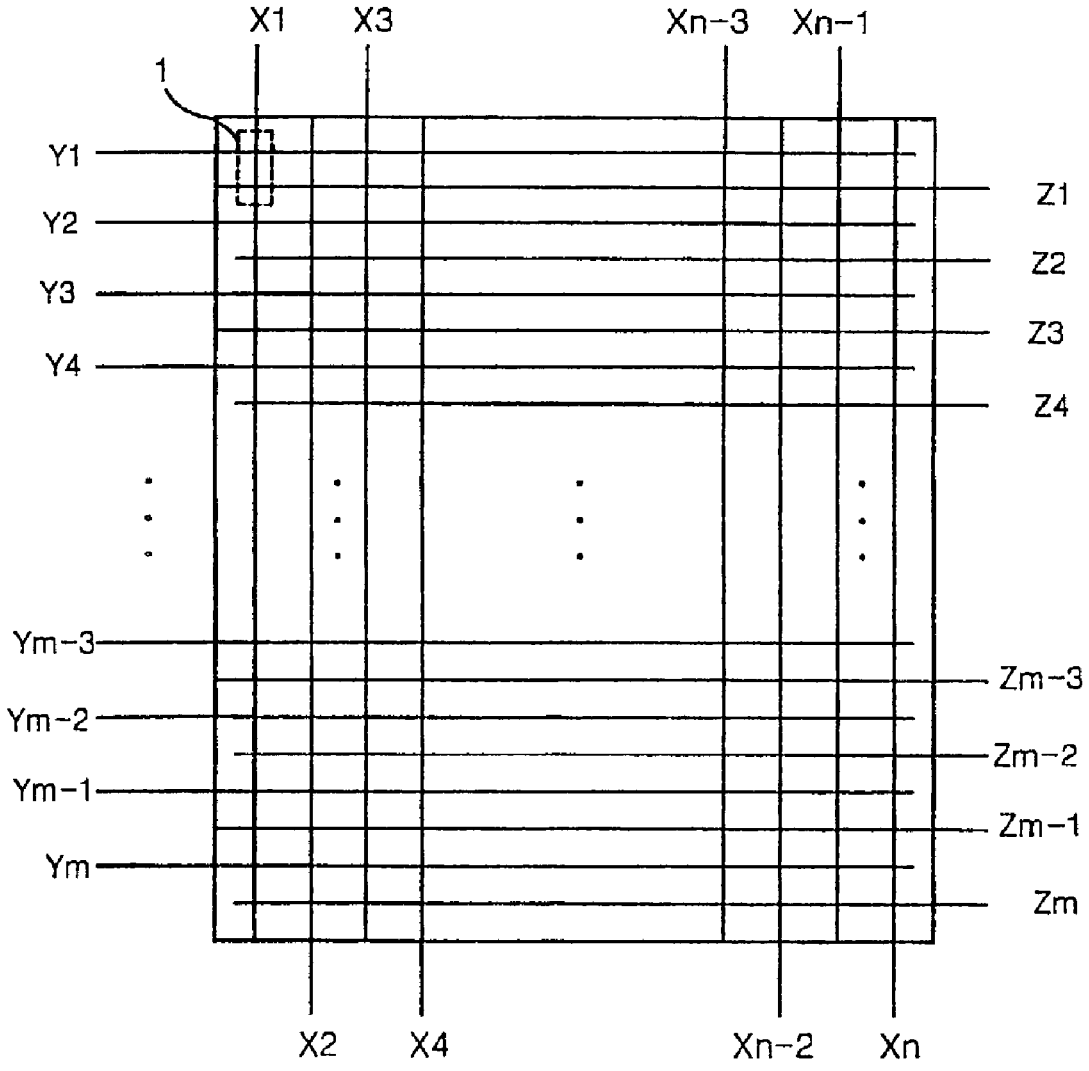
FIG. 2 CONVENTIONAL ART
FIG. 2 depicts a plasma display panel at which the discharge cells shown in FIG. 1 are arranged in a matrix type.
Figure 3:
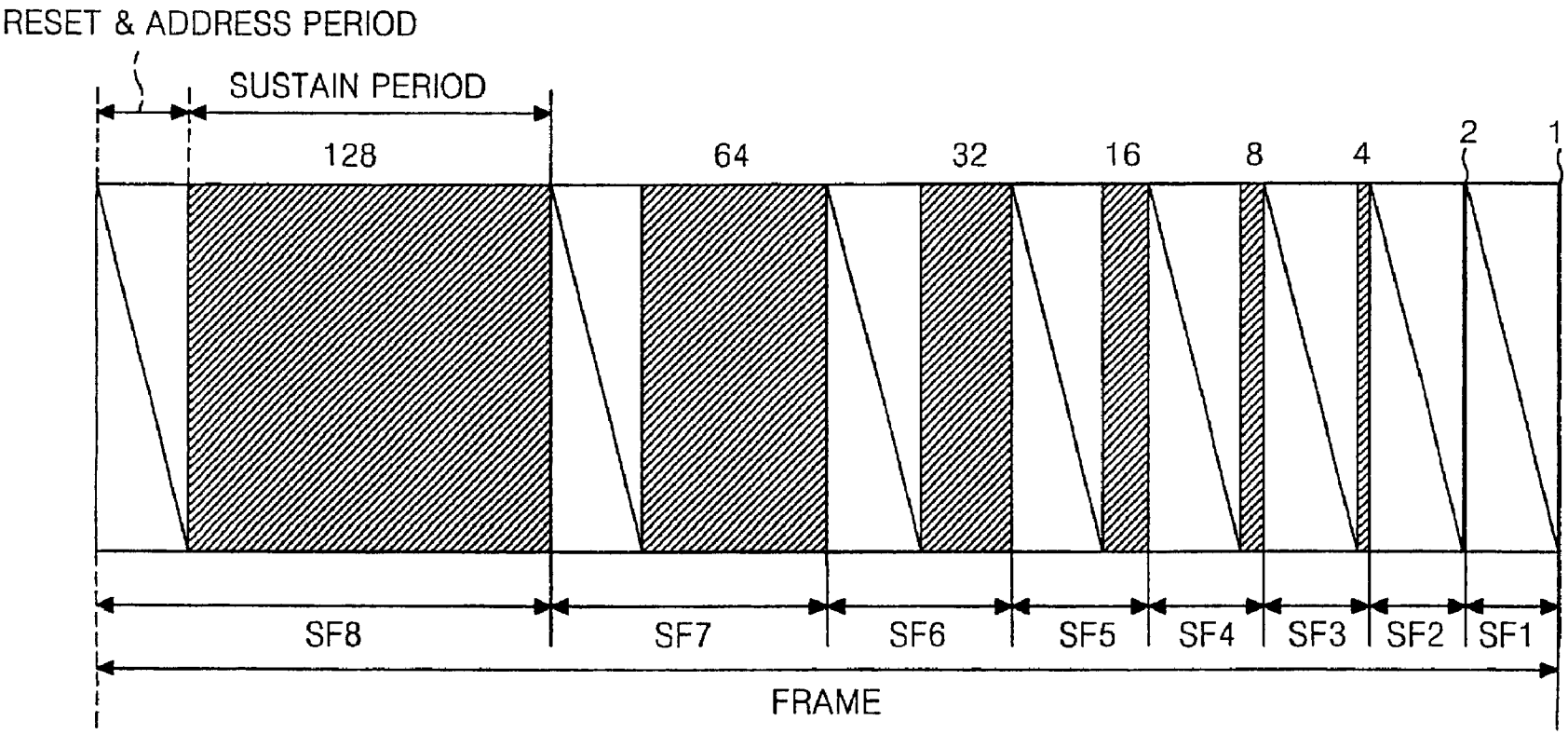
FIG.3 CONVENTIONAL ART
FIG. 3 depicts a gray scale expression method for the conventional plasma display panel.
Figure 4:
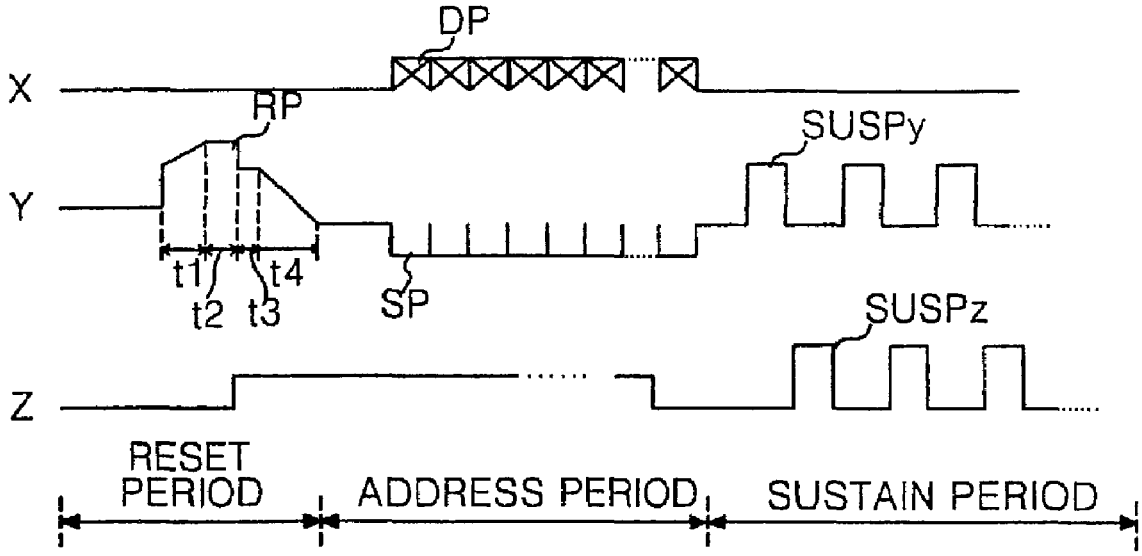
FIG. 4 CONVENTIONAL ART
FIG. 4 is a waveform diagram for explaining a method of driving the conventional plasma display panel shown in FIG. 1.
Figure 5:
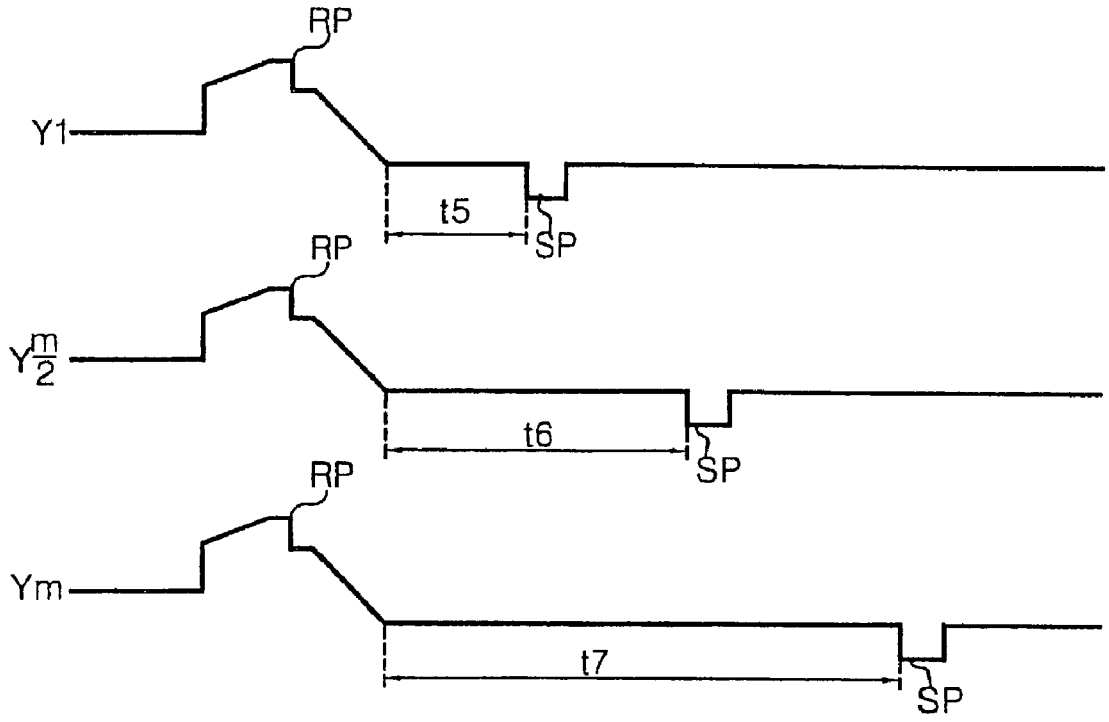
FIG. 5 CONVENTIONAL ART
FIG. 5 is a detailed waveform diagram of a driving signal applied to the conventional first electrode.
Figure 6:
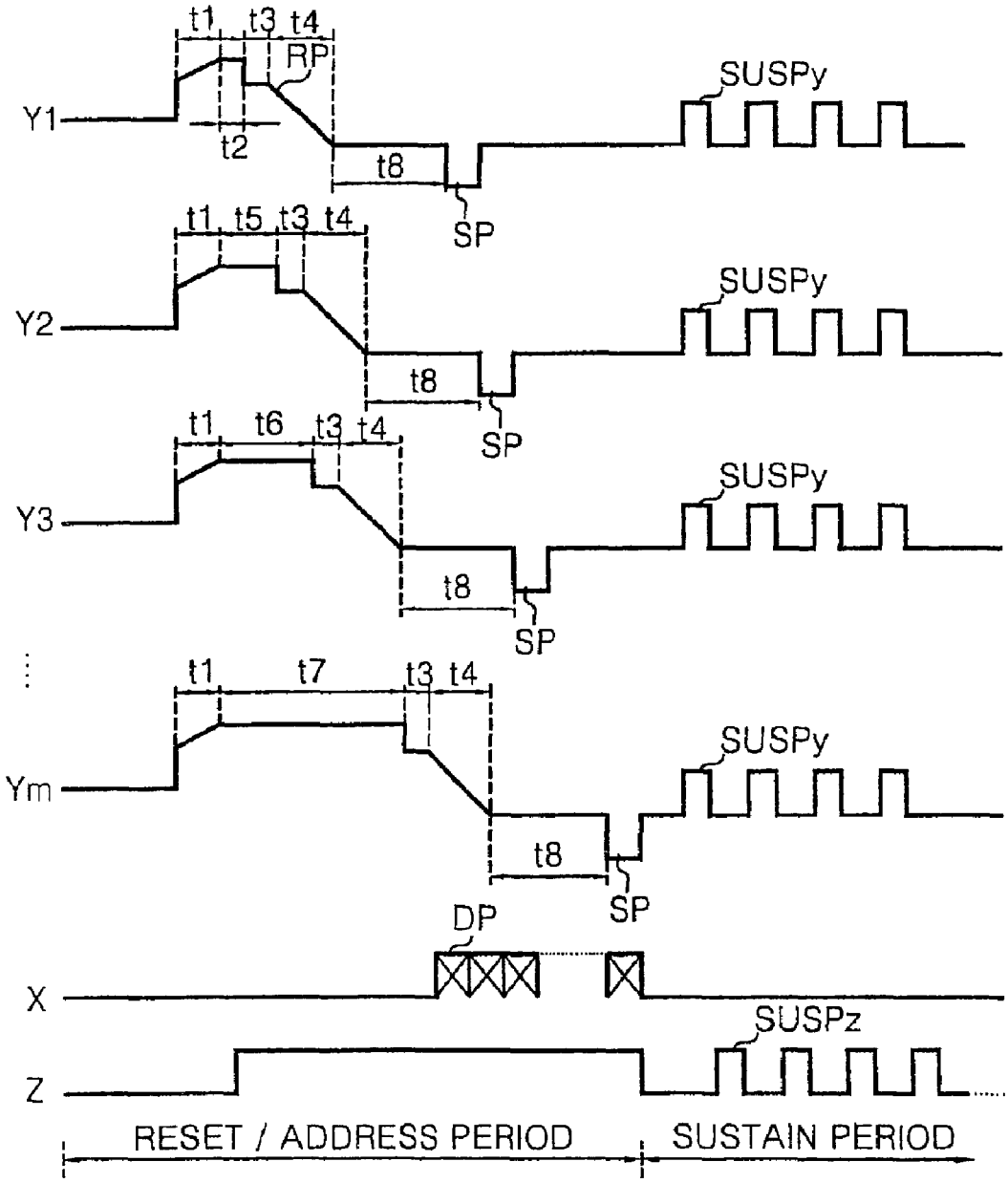
FIG. 6 is a waveform diagram for explaining a method of driving a plasma display panel according to a first embodiment of the present invention.

FIG. 6 is a waveform diagram for explaining a method of driving a plasma display panel according to a first embodiment of the present invention.

Referring to FIG. 6, in the first embodiment, the PDP is divided into a reset/address period and a sustain period for its driving. In the reset/address period, a reset pulse RP and a scanning pulse SP are applied to first electrode lines Y1 to Ym. In the sustain period, sustaining pulses SUSPy and SUSPz are alternately applied to the first electrode lines Y1 to Ym and the second electrode lines Z1 to Zm.

In such a PDP driving method according to the first embodiment, a time t8 when the scanning pulse SP is applied after an application of the reset pulse RP are set equally at the all the first electrode lines Y1 to Ym. Accordingly, when the scanning pulse SP is applied to all the discharge cells, uniform wall charges are formed at the discharge cells.

More specifically, the reset pulse RP applied to the (Y1)th first electrode line Y1 is divided into a time t1 rising until a first voltage at a desired slope, a time t2 maintaining the first voltage value, a time t3 maintaining a second voltage value lower than the first voltage value and a time t4 falling at a desired slope.

In t1, the reset pulse RP rises until the first voltage at a desired slope. At this time, a reset discharge is generated at the discharge cell to form desired wall charges. In t2, the wall charges formed in the time t1 during a desired time (i.e., t2) with the first voltage are maintained. In t3, the second voltage lower than the first voltage is maintained during a desired time (i.e., t3), and the wall charges formed at the discharge cell are maintained. In t4, the wall charges formed at the discharge cell with the first voltage value falling slowly at a desired slope are uniformly distributed. The scanning pulse SP is applied after a desired time (i.e., t8) from an application of the reset pulse RP.

Furthermore, the reset pulse RP applied to the (Y2)th first electrode Y2 is divided into a time t1 rising at a desired slope, a time t5 maintaining a first voltage value, a time t3 maintaining a second voltage value lower than the first voltage value and a time t4 falling at a desired slope. Herein, the time intervals t1, t3 and t4 are set equally so that the scanning pulse SP may be applied after a desired time (i.e., t8) from an application of the reset pulse RP, whereas the time interval t5 maintaining the first voltage value is set to be larger than the time interval t2 maintaining the first voltage value at the (Y1)th first electrode line Y1. Accordingly, in the present PDP driving method, the time intervals t8 when the scanning pulse SP is applied after an application of the reset pulse RP are set equally at all the first electrode lines Y1 to Ym.

In other words, time intervals t2, t5, t6, . . . , t7 maintaining the first voltage value in the reset pulse RP are set to have a gradually larger value so that the scanning pulse SP may be applied after a desired time (i.e., t8) from an application of the reset pulse RP. Accordingly, the PDP driving method according to the first embodiment provides a uniform address discharge with all the discharge cells, thereby causing a normal sustain discharge.

Figure 7:
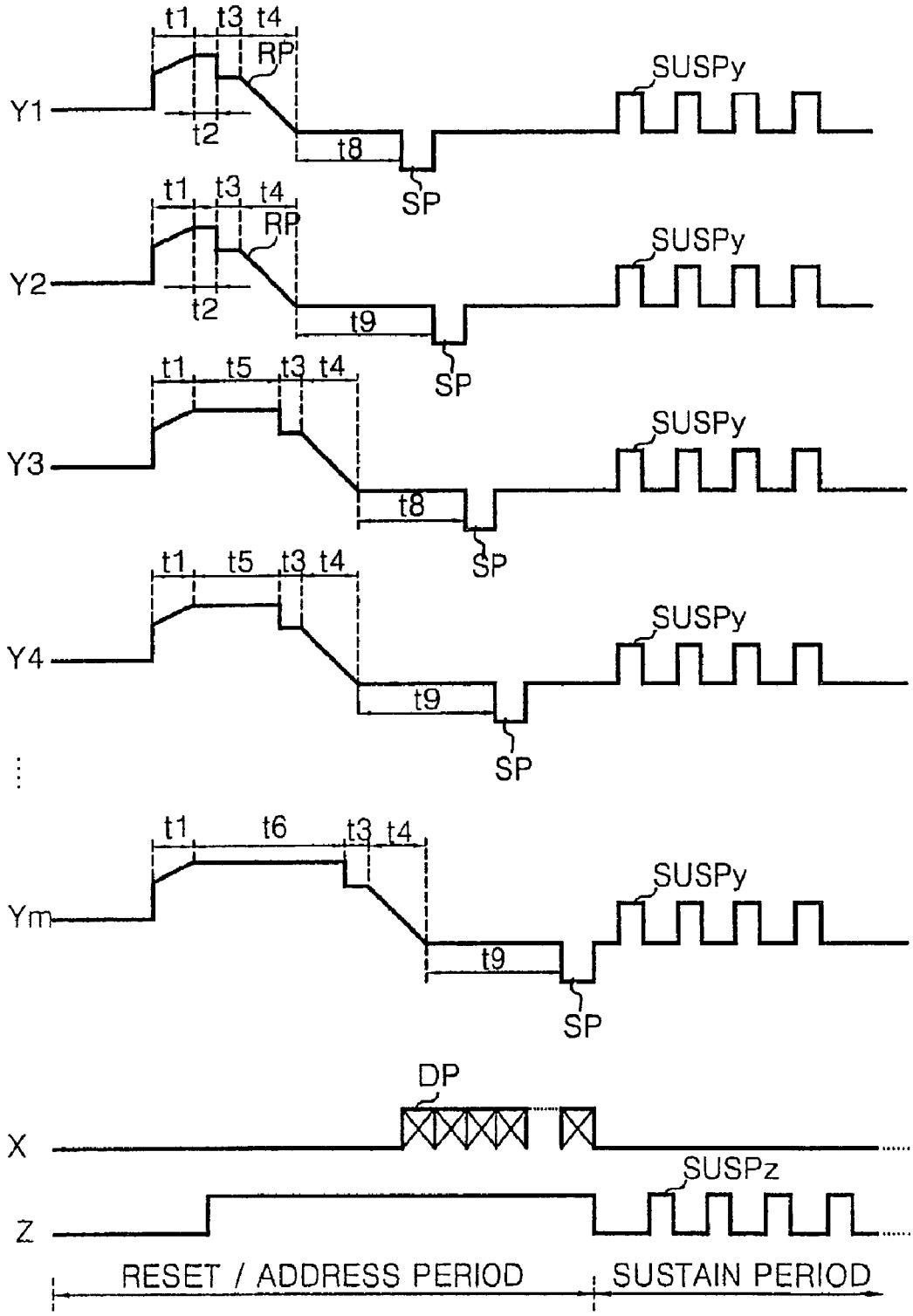
FIG. 7 is a waveform diagram for explaining a method of driving a plasma display panel according to a second embodiment of the present invention.

FIG. 7 is a waveform diagram for explaining a method of driving a plasma display panel according to a second embodiment of the present invention.

Referring to FIG. 7, in the second embodiment, the panel is divided into a plurality of blocks, each of which includes at least two first electrode lines Y, for its driving. Herein, a reset pulse RP with a different width is applied for each block.

More specifically, the reset pulse RP applied to the first block (i.e., electrodes Y1 and Y2) is divided into a time t1 rising until a first voltage at a desired slope, a time t2 maintaining the first voltage value, a time t3 maintaining a second voltage value lower than the first voltage value and a time t4 falling at a desired slope.

In t1, the reset pulse RP rises until the first voltage at a desired slope. At this time, a reset discharge is generated at the discharge cell to form desired wall charges. In t2, the wall charges formed in the time tl during a desired time (i.e., t2) with the first voltage are maintained. In t3, the second voltage lower than the first voltage is maintained during a desired time (i.e., t3), and the wall charges formed at the discharge cell are maintained. In t4, the wall charges formed at the discharge cell with the first voltage value falling slowly at a desired slope are uniformly distributed.

If the same reset pulses RP are applied to the first electrode lines Y1 and Y2 included in the first block, then the scanning pulse SP applied to the first electrode line Y1 is applied after a time t8. Further, the scanning pulse SP applied to the first electrode line Y2 is applied after a time t9. In other words, since the reset pulses RP having the same width are applied to the first electrode lines Y1 and Y2 included in the first block, an application time of the scanning pulse SP after an application of the reset pulse RP becomes different. Herein, since the scanning pulse SP is sequentially applied to the first electrode lines Y1 and Y2 included in the first block, that is, since a time difference between t8 and t9 is not large, wall charges produced by the reset pulse RP is not re-bound. Accordingly, the discharge cells included in the first block can cause a stable address discharge and a stable sustain discharge.

Furthermore, the reset pulse RP applied to the second block (i.e., electrode lines Y3 and Y4) is divided into a time t1 rising at a desired slope, a time t5 maintaining a first voltage value, a time t3 maintaining a second voltage value lower than the first voltage value and a time t4 falling at a desired slope. Herein, the time intervals t1, t3 and t4 are set equally so that the scanning pulse SP may be applied after a desired time (i.e., t8 and t9) from an application of the reset pulse RP, whereas the time interval t5 maintaining the first voltage value is set to be larger than the time interval t2 at the first block. Accordingly, in the present PDP driving method, the time intervals t8 and t9 when the scanning pulse SP is applied after an application of the reset pulse RP are set equally for all the blocks.

In other words, time intervals t1, t3 and t4 of the reset pulse RP applied to all the first blocks are set equally for the all the blocks so that the scanning pulse SP may be applied after a desired time (i.e., t8 and t9) from an application of the reset pulse RP, whereas time intervals t2, t5 and t6 maintaining the first voltage value are set differently. Accordingly, the PDP driving method according to the second embodiment can form uniform wall charges at all the blocks.

Figure 8:
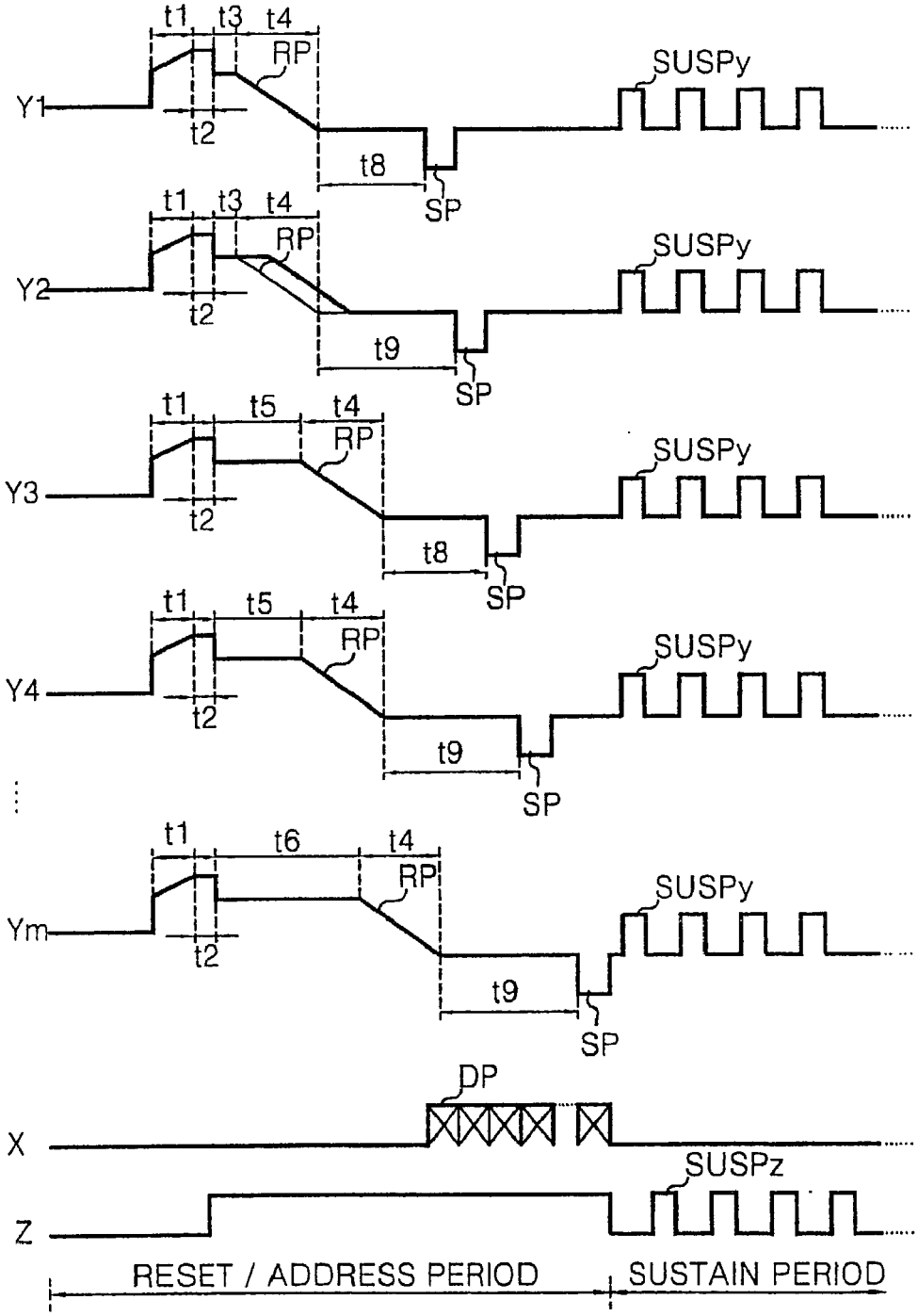
FIG. 8 is a waveform diagram for explaining a method of driving a plasma display panel according to a third embodiment of the present invention.

FIG. 8 is a waveform diagram for explaining a method of driving a plasma display panel according to a third embodiment of the present invention.

Referring to FIG. 8, in the third embodiment, the PDP is divided into a reset/address period and a sustain period for its driving. In the reset/address period, a reset pulse RP and a scanning pulse SP are applied to first electrode lines Y1 to Ym. In the sustain period, sustaining pulses SUSPy and SUSPz are alternately applied to the first electrode lines Y1 to Ym and the second electrode lines Z1 to Zm.

In such a PDP driving method according to the third embodiment, a time t8 when the scanning pulse SP is applied after an application of the reset pulse RP are set equally for the all the first electrode lines Y1 to Ym. Accordingly, when the scanning pulse SP is applied to all the discharge cells, uniform wall charges are formed at the discharge cells.

More specifically, the reset pulse RP applied to the (Y1)th first electrode line Y1 is divided into a time t1 rising until a first voltage at a desired slope, a time t2 maintaining the first voltage value, a time t3 maintaining a second voltage value lower than the first voltage value and a time t4 falling at a desired slope.

In t1, the reset pulse RP rises until the first voltage at a desired slope. At this time, a reset discharge is generated at the discharge cell to form desired wall charges. In t2, the wall charges formed in the time t1 during a desired time (i.e., t2) with the first voltage are maintained. In t3, the second voltage lower than the first voltage is maintained during a desired time (i.e., t3), and the wall charges formed at the discharge cell are maintained. In t4, the wall charges formed at the discharge cell with the first voltage value falling slowly at a desired slope are uniformly distributed. The scanning pulse SP is applied after a desired time (i.e., t8) from an application of the reset pulse RP.

Furthermore, the reset pulse RP applied to the (Y2)th first electrode Y2 is divided into a time t1 rising at a desired slope, a time t2 maintaining a first voltage value, a time t5 maintaining a second voltage value lower than said voltage value applied in the time interval t2 and a time t4 falling at a desired slope. Herein, the time intervals t1, t3 and t4 are set equally for all the first electrode lines Y1 to Ym so that the scanning pulse SP may be applied after a desired time (i.e., t8) from an application of the reset pulse RP, whereas the time interval t5 maintaining the second voltage value is set to be larger than the time interval t3 maintaining the second voltage value at the (Y1)th first electrode line Y1. Accordingly, in the present PDP driving method, the time intervals t8 when the scanning pulse SP is applied after an application of the reset pulse RP are set equally for all the first electrode lines Y1 to Ym.

In other words, time intervals t3, t5, t6, . . . , t7 maintaining the second voltage value in the reset pulse RP are set to have a gradually larger value so that the scanning pulse SP may be applied after a desired time (i.e., t8) from an application of the reset pulse RP. Accordingly, the PDP driving method according to the third embodiment causes an address discharge after constant (i.e., uniform) wall charges were formed at all the discharge cells, so that it can improve a picture quality.

Alternatively, the first embodiment may be combined with the third embodiment such that an address discharge can occur after constant wall charges were formed at all the discharge cells. In other words, a time interval maintaining the first voltage and a time interval maintaining the second voltage may be set to have a sequentially larger value, that is, to have a larger value at an application sequence of the scanning pulse SP.

Figure 9:
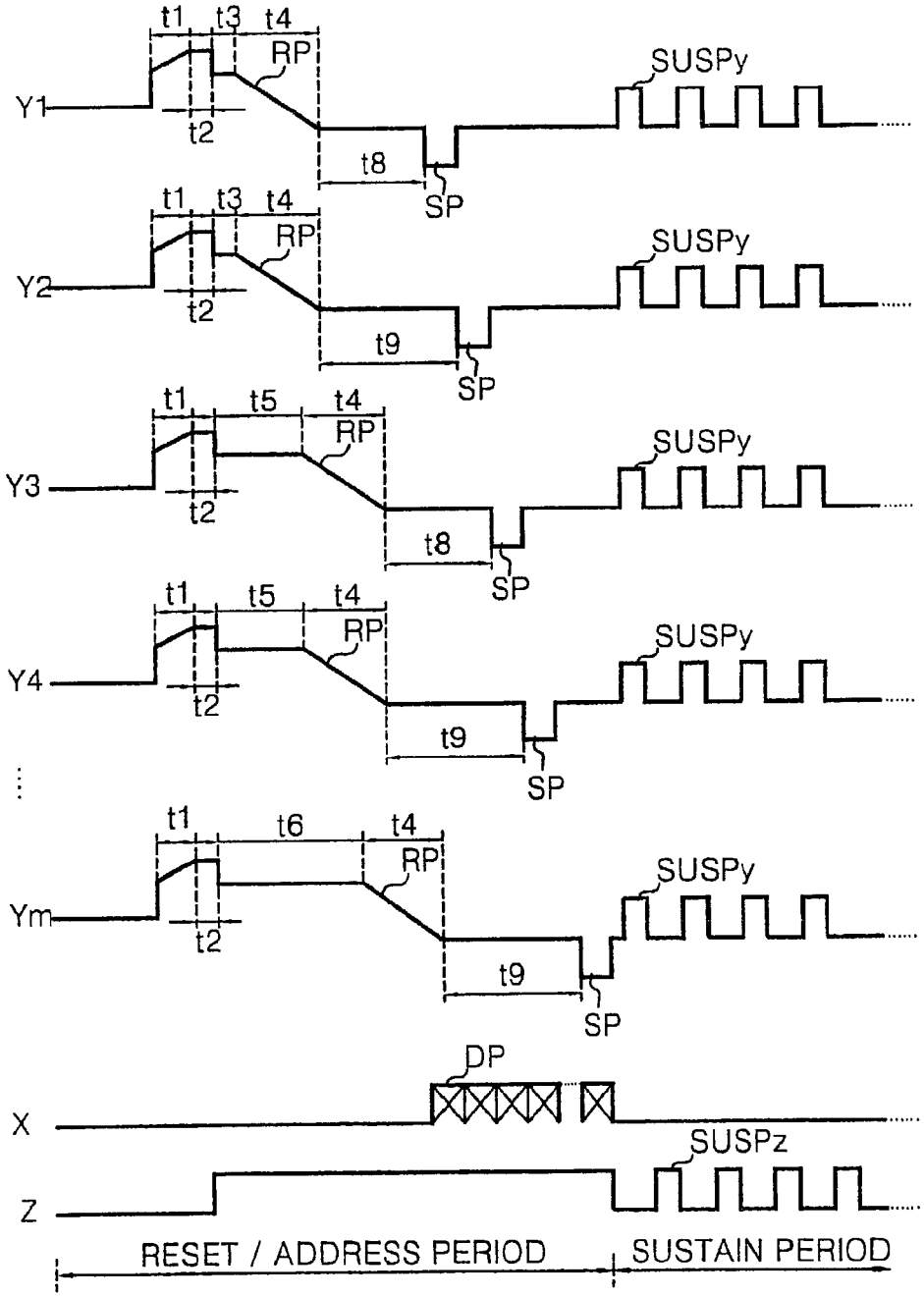
FIG. 9 is a waveform diagram for explaining a method of driving a plasma display panel according to a fourth embodiment of the present invention.

FIG. 9 is a waveform diagram for explaining a method of driving a plasma display panel according to a fourth embodiment of the present invention.

Referring to FIG. 9, in the fourth embodiment, the panel is divided into a plurality of blocks, each of which includes at least two first electrode lines Y, for its driving. Herein, a reset pulse RP with a different width is applied for each block.

More specifically, the reset pulse RP applied to the first block (i.e., electrode lines Y1 and Y2) is divided into a time t1 rising until a first voltage at a desired slope, a time t2 maintaining the first voltage value, a time t3 maintaining a second voltage value lower than the first voltage value and a time t4 falling at a desired slope.

In t1, the reset pulse RP rises until the first voltage at a desired slope. At this time, a reset discharge is generated at the discharge cell to form desired wall charges. In t2, the wall charges formed in the time t1 during a desired time (i.e., t2) with the first voltage are maintained. In t3, the second voltage lower than the first voltage is maintained during a desired time (i.e., t3), and the wall charges formed at the discharge cell are maintained. In t4, the wall charges formed at the discharge cell with the first voltage value falling slowly at a desired slope are uniformly distributed.

If the same reset pulses RP are applied to the first electrode lines Y1 and Y2 included in the first block, then the scanning pulse SP applied to the first electrode line Y1 is applied after a time t8. Further, the scanning pulse SP applied to the first electrode line Y2 is applied after a time t9. In other words, since the reset pulses RP having the same width are applied to the first electrode lines Y1 and Y2 included in the first block, an application time of the scanning pulse SP after an application of the reset pulse RP becomes different. However, since the scanning pulse SP is sequentially applied to the first electrode lines Y1 and Y2 included in the first block, that is, since a time difference between t8 and t9 is not large, wall charges produced by the reset pulse RP are not re-bound.

Furthermore, the reset pulse RP applied to the second block (i.e., electrode lines Y3 and Y4) is divided into a time t1 rising at a desired slope, a time t2 maintaining a first voltage value, a time t5 maintaining a second voltage value lower than said voltage value applied in the time interval t2 and a time t4 falling at a desired slope. Herein, the time intervals t1, t2 and t4 are set equally so that the scanning pulse SP may be applied after a desired time (i.e., t8 and t9) from an application of the reset pulse RP, whereas the time interval t5 maintaining the first voltage value is set to be larger than the time interval t3 at the first block. Accordingly, in the present PDP driving method, the time intervals t8 and t9 when the scanning pulse SP is applied after an application of the reset pulse RP are set equally for all the blocks.

In other words, time intervals t3, t5, . . . , t6 maintaining the second voltage value of the reset pulse RP are set to have a gradually larger value so that the scanning pulse SP may be applied after a desired time (i.e., t8 and t9) from an application of the reset pulse RP.

Figure 10:
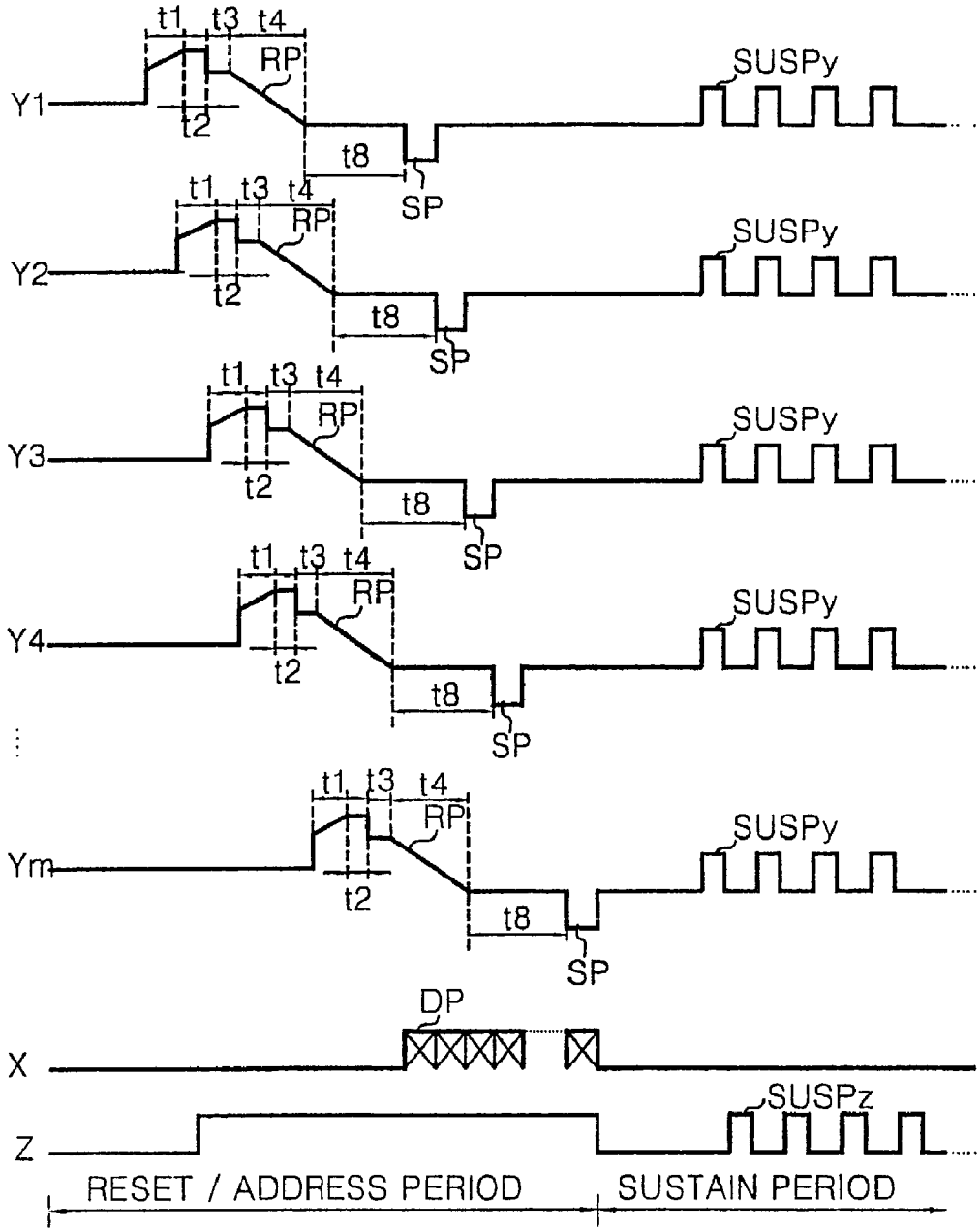
FIG. 10 is a waveform diagram for explaining a method of driving a plasma display panel according to a fifth embodiment of the present invention.

FIG. 10 is a waveform diagram for explaining a method of driving a plasma display panel according to a fifth embodiment of the present invention.

Referring to FIG. 10, in the fifth embodiment, an application time of the reset pulse RP is set differently such that time t8 when the scanning pulse SP is applied after an application of the reset pulse RP is equal for all the first electrode lines Y1 to Ym. Accordingly, when the scanning pulse SP is applied to all the discharge cells, uniform wall charges are formed at the discharge cells.

More specifically, the scanning pulse SP is applied after the lapse of t8 from an application of the reset pulse RP to the (Y1)th first electrode line Y1. The reset pulse RP applied to the (Y2)th first electrode line Y2 is applied at a later time than the reset pulse RP applied to the (Y1)th first electrode line Y1. At this time, an application timing of the reset pulse RP to the (Y2)th first electrode line Y2 is set such that the scanning pulse SP can be applied after a time t8 from an application of the reset pulse RP. In other words, in the fifth embodiment of the present invention, an application time of the reset pulse RP is set differently for all the first electrode lines Y1 to Ym, so that uniform wall charges can be formed at the discharge cells. Accordingly, an address discharge occurs after constant (i.e., uniform) wall charges were formed at all the discharge cells, thereby improving a picture quality.

In the mean time, the first to fifth embodiments are applicable to a plasma display panel adopting a dual scan system.

Figure 11:
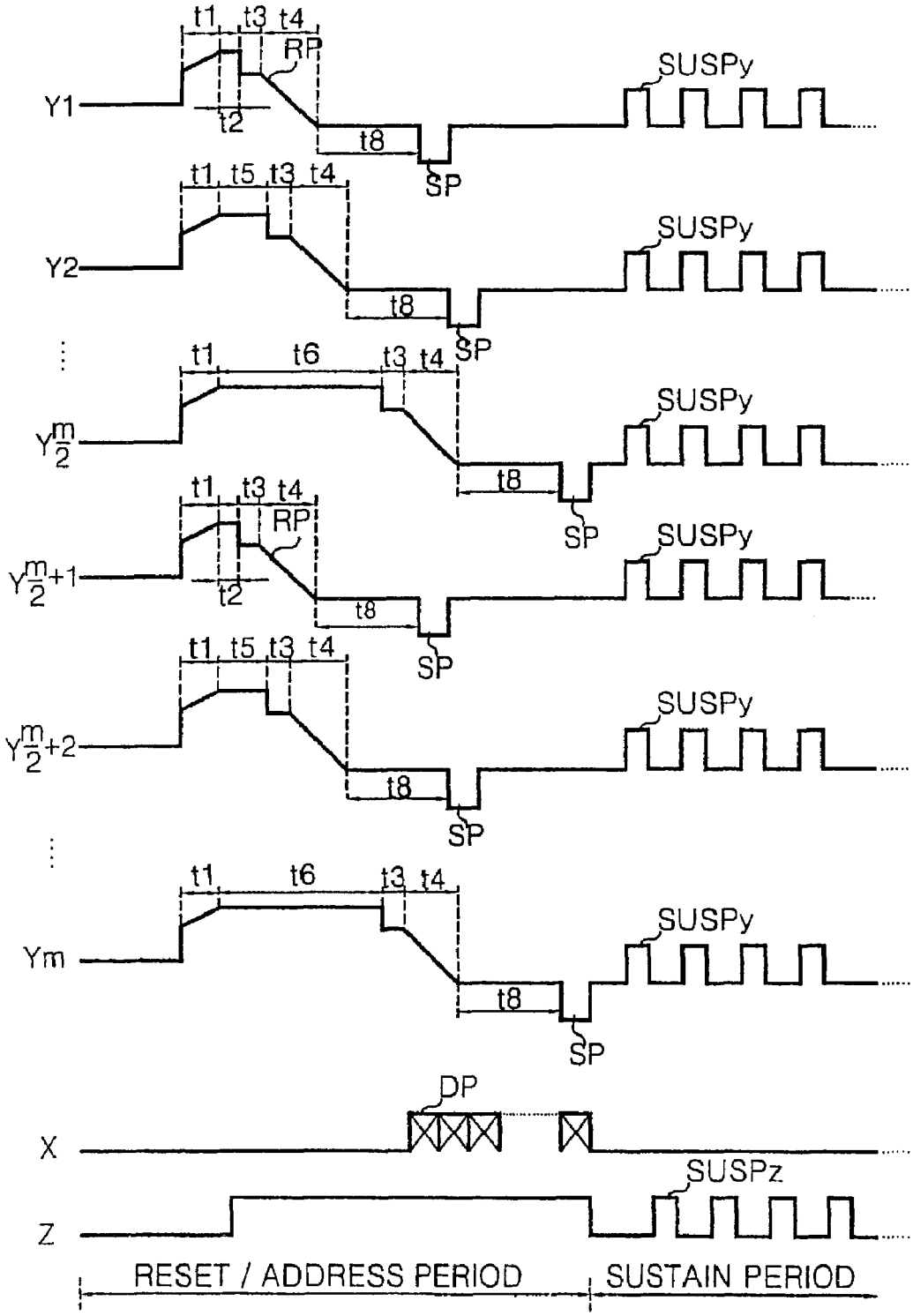
FIG. 11 is a waveform diagram for explaining a method of driving a plasma display panel according to a sixth embodiment of the present invention.

For instance, if the first embodiment is applied to a plasma display panel employing a dual scan system, then a driving waveform as shown in FIG. 11 emerges.

Referring to FIG. 11, in the PDP driving method according to a sixth embodiment of the present invention, the first electrode lines Y1 to Ym are divided into an upper block Y1 to Ym/2 and a lower block Ym/2+1 to Ym. The first electrode lines Y1 to Ym/2 included in the upper block are driven in a similar manner to the first embodiment of the present invention. Further, the first electrode lines Ym/2+1 to Ym included in the lower block is driven in a similar manner to the upper block. Accordingly, in the PDP driving method according to the sixth embodiment, an address discharge occurs after constant wall charges were formed at all the discharge cells, thereby improving a picture quality. Such a dual scan system is similarly applicable to the second to fifth embodiments.

Figure 12:
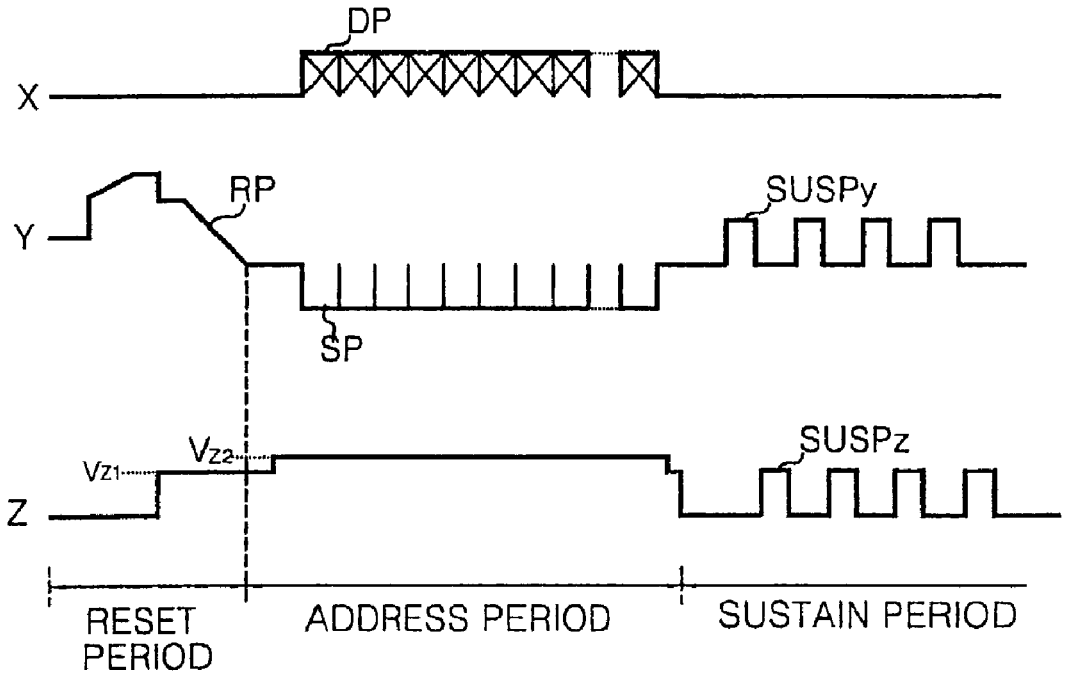
FIG. 12 is a waveform diagram for explaining a method of driving a plasma display panel according to a seventh embodiment of the present invention.
Figure 13:
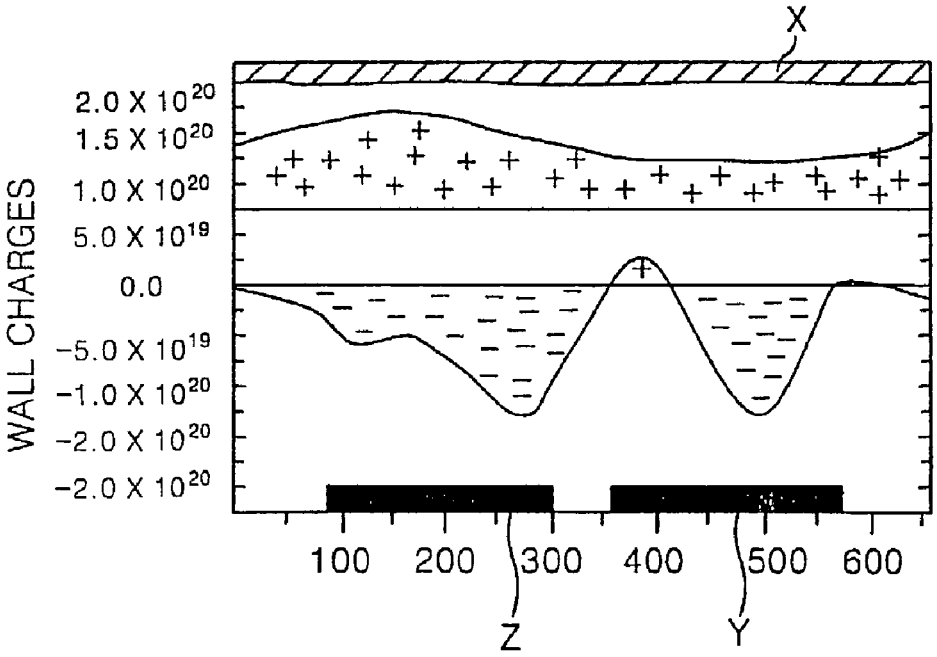
FIG. 13 represents electric charges produced by the reset discharge in FIG. 12.

FIG. 12 is a waveform diagram for explaining a method of driving a plasma display panel according to a seventh embodiment of the present invention.

Referring to FIG. 12, in the seventh embodiment, the PDP is divided into a reset period, an address period and a sustain period for its driving. In the reset period, a reset pulse RP is applied to first electrode lines Y1 to Ym to form uniform wall charges at the discharge cell. In the address period, a scanning pulse SP is applied to the first electrode lines Y1 to Ym, and a data pulse DP is applied to the address electrode lines X1 to Xn. At this time, an address discharge is generated at the discharge cells to which the scanning pulse SP and the address pulse DP has been applied. In the sustain period, sustaining pulses SUSPy and SUSPz are alternately applied to the first electrode lines Y1 to Ym and the second electrode lines Z1 to Zm, thereby allowing the discharge cell at which the address discharge has been generated to cause a sustain discharge.

In such a PDP driving method according to the seventh embodiment, when the reset pulse RP is applied to the first electrode lines Y1 to Ym, a first voltage Vz1 is applied to the second electrode lines Z1 to Zm. Further, when the scanning pulse SP is applied to the first electrode lines Y1 to Ym, a second voltage Vz2 having a higher voltage value than the first voltage Vz1 is applied to the second electrode lines Z1 to Zm. The second voltage Vz2 applied to the second electrode lines Z1 to Zm is applied before an application of the scanning pulse SP to the 1st first electrode line Y1 after a termination of the reset pulse RP. Such a second voltage Vz2 is maintained until the last scanning pulse SP is applied to the first electrode line Ym. If the second voltage Vz2 is applied to the second electrode line Z, then it becomes possible to prevent an expiration of wall charges produced in the reset period to thereby cause a stable address discharge.

More specifically, positive wall charges are formed at the address electrode X while negative wall charges are formed at the first and second electrodes Y and Z, as shown in FIG. 12, by the reset discharge generated in the reset period. In other words, a positive reset pulse RP is applied to the first electrode Y to form negative wall charges. On the other hand, positive wall charges are formed at the address electrode X having a relatively lower level than the first and second electrodes Y and Z. After such a reset period, the second voltage Vz2 having a higher voltage level than the first voltage Vz1 is applied to the second electrode Z.

If a positive second voltage Vz2 is applied to the second electrode Z, then a re-binding of negative wall charges formed at the second electrode Z is prevented. In other words, a positive second voltage Vz2 is applied to the second electrode Z to maintain wall charges formed at the second electrode Z. In the seventh embodiment, the second voltage Vz2 is applied to the second electrode Z before an application of the first scanning pulse SP after an application of the reset pulse RP. Accordingly, the PDP driving method according to the seventh embodiment can cause a stable address discharge to improve a picture quality of the PDP.

As described above, according to the present invention, an application time of the scanning pulse after an application of the reset pulse to all the discharge cells is set equally for each line or for each block, so that it becomes possible to form uniform wall charges at the discharge cell. Accordingly, the discharge cells to which the data pulse has been applied in the address period can a stable address discharge.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel including a reset period and an address period, said method comprising the steps of:

applying a corresponding scanning pulse to each of a plurality of first electrodes so as to select discharge cells in said address period;

applying data pulses synchronized with the scanning pulses to address electrodes arranged to cross the first electrodes; and applying a corresponding reset pulse to each of the first electrodes in the reset period, and setting a different pulse width for each of the reset pulses depending upon an application sequence of the corresponding scanning pulses.

2. The method as claimed in claim 1, wherein said pulse width of each of the reset pulses is set such that the scanning pulses can be applied to all the first electrodes after the lapse of the same time from an application of the reset pulses.

3. The method as claimed in claim 1, wherein said reset pulse includes:

a rising step rising at a desired slope until a first voltage;

a first sustain step for sustaining said first voltage during a desired time;

a second sustain step for sustaining a second voltage having a lower voltage value than the first voltage during a certain time; and a falling step falling at a desired slope from the second voltage.

4. The method as claimed in claim 3, wherein a width of the first sustain step is set such that said scanning pulses can be applied to all the first electrodes after the lapse of the same time from an application of each of the reset pulses.

5. The method as claimed in claim 4, wherein widths of the rising step, the second sustain step and the falling step are set equally at all of the reset pulses applied to the first electrodes.

6. The method as claimed in claim 3, wherein a width of the second sustain step is set such that said scanning pulses can be applied to all the first electrodes after the lapse of the same time from an application of each of the reset pulses.

7. The method as claimed in claim 6, wherein widths of the rising step, the first sustain step and the falling step are set equally at all of the reset pulses applied to the first electrodes.

8. The method as claimed in claim 3, wherein widths of the first sustain step and the second sustain step are set such that said scanning pulses can be applied to all the first electrodes after the lapse of the same time from an application of each of the reset pulse.

9. The method as claimed in claim 8, wherein widths of the rising step and the falling step are set equally at all of the reset pulses applied to the first electrodes.

10. The method as claimed in claim 3, wherein said plasma display panel is divided into a plurality of blocks, each of which includes at least two first electrodes, for its driving.

11. The method as claimed in claim 10, wherein a width of at least one of the first and second sustain steps is set such that said scanning pulses can be applied to the first electrodes after the lapse of the same time after an application of each of the reset pulses for each block.

12. The method as claimed in claim 10, wherein reset pulses with the same width are applied the first electrodes included in the same block.

13. The method as claimed in claim 3, wherein said plasma display panel is divided into an upper block and a lower block, which are driven simultaneously.

14. A method of driving a plasma display panel including a reset period and an address period, said method comprising the steps of:

applying a scanning pulse to first electrodes so as to select a discharge cell in said address period;

applying a data pulse synchronized with the scanning pulse to address electrodes arranged to cross the first electrodes; and applying reset pulses each having a different application time, depending upon positions of the first electrodes, in said reset period.

15. The method as claimed in claim 14, wherein said application time of the reset pulse is set such that the scanning pulse can be applied to the first electrodes after the lapse of the same time.

16. The method as claimed in claim 14, wherein said plasma display panel is divided into an upper block and a lower block, which are driven simultaneously.

17. A method of driving a plasma display panel, comprising the steps of:

applying a reset pulse with a ramp waveform shape to first electrodes in a reset period;

applying a scanning pulse to the first electrodes in an address period;

applying a data pulse synchronized with the scanning pulse so as to select a discharge cell in said address period;

applying a first voltage to second electrodes being adjacent to the first electrodes when said ramp waveform is applied to the first electrodes; and applying a second voltage to the second electrodes before an application of the first scanning pulse to the first electrode after an application of said ramp waveform to the first electrodes.

18. The method as claimed in claim 17, wherein said second voltage is set to have a higher voltage level than said first voltage.

19. A method of driving a plasma display panel having first electrode lines, second electrode lines and address electrode lines, the method comprising:

applying scanning pulses to the first electrode lines;

applying data pulses corresponding to the scanning pulses to the address electrode lines; and applying reset pulses to the first electrode lines, wherein a width of each of the reset pulses is based on a timing of the scanning pulses applied to the first electrode lines.

20. The method as claimed in claim 19, wherein each of the reset pulses have a similar polarity.

21. The method as claimed in claim 19, further comprising alternately applying sustain pulses to one of the first electrode lines and one of the second electrode lines.

22. The method as claimed in claim 19, wherein at least one of the reset pulses includes:

a rising portion rising at a slope to a first voltage;

a first sustain portion for sustaining the first voltage during a desired time;

a second sustain portion for sustaining a second voltage having a lower voltage value than the first voltage during a certain time; and a falling portion falling at a slope from the second voltage.

23. The method as claimed in claim 22, wherein a width of the first sustain portion is set such that said scanning pulse can be applied to all the first electrode lines after a lapse of a same time from an application of each of the reset pulses.

24. The method as claimed in claim 22, wherein a width of the second sustain portion is set such that said scanning pulse can be applied to all the first electrode lines after a lapse of a same time from an application of each of the reset pulses.

25. A method of driving a plasma display panel having a plurality of first electrode lines, a plurality of second electrode lines and address electrode lines, the method comprising:

applying a first reset pulse to one first electrode line;

applying a second reset pulse to one second electrode line;

applying a scanning pulse to each of the one first electrode line and the one second electrode line; and applying data pulses to address electrode lines, each of the data pulses to correspond with one of the scanning pulses, wherein a width of the first reset pulse and a width of the second reset pulse are differently set based on the scanning pulses.

26. The method as claimed in claim 25, wherein each of the reset pulses have a similar polarity.

27. The method as claimed in claim 25, further comprising alternately applying sustain pulses to the one first electrode line and the one second electrode line.

28. The method as claimed in claim 25, wherein each reset pulse includes:

a rising portion rising at a slope to a first voltage;

a first sustain portion for sustaining the first voltage during a desired time;

a second sustain portion for sustaining a second voltage having a lower voltage value than the first voltage during a certain time; and a falling portion falling at a slope from the second voltage.

29. The method as claimed in claim 25, wherein a width of the first sustain portion is set such that said scanning pulse can be applied to all the first electrode lines after a lapse of a same time from an application of each of the reset pulses.

30. The method as claimed in claim 25, wherein a width of the second sustain portion is set such that said scanning pulse can be applied to all the first electrode lines after a lapse of a same time from an application of each of the reset pulses.

31. A method of driving a plasma display panel including a reset period and an address period, said method comprising:

applying a scanning pulse to first electrodes so as to select a discharge cell in said address period;

applying a data pulse synchronized with the scanning pulse to address electrodes arranged to traverse the first electrodes; and applying a reset pulse to the first electrodes in the reset period, and setting a pulse width of the reset pulse differently depending upon an application sequence of the scanning pulse, wherein said reset pulse includes:

a rising portion rising at a slope to a first voltage;

a first sustain portion for sustaining said first voltage;

a second sustain portion for sustaining a second voltage having a lower voltage value than the first voltage; and a falling portion falling at a slope from the second voltage.

* * * * *